US006261209B1

(12) United States Patent
Coody

(10) Patent No.: US 6,261,209 B1
(45) Date of Patent: Jul. 17, 2001

(54) FOLDING EXERCISE TREADMILL WITH FRONT INCLINATION

(75) Inventor: Bruce F. Coody, Spring, TX (US)

(73) Assignee: Fitness Quest, Inc., Canton, OH (US)

( * ) Notice: Subject to any disclaimer, the term of this patent is extended or adjusted under 35 U.S.C. 154(b) by 0 days.

(21) Appl. No.: 09/320,109

(22) Filed: May 26, 1999

Related U.S. Application Data

(60) Provisional application No. 60/087,231, filed on May 29, 1998.

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,839,993 * 1/1999 Fox ..... 482/54
5,860,893 * 1/1999 Watterson et al. ..... 482/51

* cited by examiner

*Primary Examiner*—Glenn E. Richman
(74) *Attorney, Agent, or Firm*—Sand & Sebolt

(57) ABSTRACT

A treadmill includes a tread structure attached to a support structure and is moveable between an exercise configuration and a storage configuration. The tread structure has a front that is selectively adjustable in the vertical direction by an inclination mechanism to selectively vary the inclination of the tread structure with respect to the floor. The inclination mechanism pivots about pivot hubs. The tread structure includes a pivot member from which the tread structure is lifted. The pivot hubs are disposed in the direction of the rear of the tread structure from the pivot member. The tread structure is securable to the support structure by a latch pin when the treadmill is in the storage configuration. In the first embodiment, the pivot member is disposed near the front of the tread structure and is slightly spaced rearward therefrom. A second embodiment is presented wherein the pivot member is disposed along the frontmost portion of the tread structure. A third embodiment is presented in which a pair of pressurized gas cylinders provide additional lifting force to facilitate converting the treadmill from the exercise configuration to the storage configuration.

24 Claims, 7 Drawing Sheets

FOLDING EXERCISE TREADMILL WITH FRONT INCLINATION

CROSS REFERENCE TO RELATED APPLICATION

The present application is a utility application claiming priority from U.S. Provisional Application Ser. No. 60/087,231, filed May 28, 1998, the disclosures of which are incorporated herein by reference.

BACKGROUND OF THE INVENTION

1. Technical Field

The invention relates generally to exercise equipment and, more particularly, to exercise treadmills. Specifically, the invention relates to an exercise treadmill having a fold-up capability to reduce the floor space occupied by the exercise treadmill when not in use, the front of the treadmill being selectively adjustable in the vertical direction to vary the inclination of the tread structure with respect to the floor.

2. Background Information

Motorized exercise treadmills have become standard equipment in gymnasiums, spas, and work-out clinics. The popularity of exercise treadmills has reached such a level that consumers are interested in obtaining treadmills for private home use. Typically, exercise treadmills have been constructed as one-piece devices consisting of a long rectangular tread structure or base extending from a support structure or frame. These treadmills in their simplest form include an endless belt that moves over an underlying support composed of rollers. The belt is powered by an electric motor that moves the belt at selectively varying speeds.

Treadmills also commonly include some type of inclination mechanism that positions the treadmill at various angles of inclination with respect to the floor to simulate walking or running up a grade. Various mechanisms are employed to raise and lower the front end of an exercise treadmill relative to the floor or other support surface on which the treadmill is positioned. These mechanisms usually consist of adjustable attachments or appendages connected to the underside of the treadmill.

A significant drawback of these exercise treadmills is their size. They are large, bulky structures that occupy significant areas of floor space. To remedy the space problem and promote more private home use of exercise treadmills, treadmills have been modified from a solid one-piece structure to a collapsible two-piece structure that allows for reorientation of the tread structure for compact storage.

Fold-up treadmills that have been developed for home use typically consist of a tread structure attached to a support structure, with the tread structure being selectively moveable between an exercise configuration in which the user may run, jog, walk, or perform other exercises on the tread structure and storage configuration wherein the tread structure is rearranged into a generally upright position. When the treadmill is in the storage configuration the tread structure is rotated upward and away from the floor, thus significantly reducing the amount of floor space required by the treadmill when in the storage configuration. Such treadmills have not, however, been without limitation.

Many fold-up type treadmills have been limited by an inclination mechanism operatively attached only to the rear of the tread structure. The typical type of front inclination mechanism employed on non-fold-up treadmills has not be used with reorienting treadmills because attachments or appendages that lift the front of the tread structure have not allowed sufficient clearance for the tread structure to be reoriented into a fold-up position. Such front-lifting mechanisms also have occupied significant areas of floor space, thus minimizing any advantage obtained by folding the tread structure to the storage configuration. Rear inclination is less desirable than front inclination inasmuch as it is less effective in creating or simulating an uphill incline. The need thus exists for a treadmill that has a fold-up capability and that has an inclination mechanism mounted to the front of the tread structure that occupies minimal floor space.

SUMMARY OF THE INVENTION

In view of the foregoing, an objective of the present invention is to provide a treadmill having a fold-up capability.

Another objective of the present invention is to provide a treadmill having an inclination mechanism operatively disposed at the front of the tread structure.

Another objective of the present invention is to provide a treadmill having an inclination mechanism that employs an adjustment drive substantially aligned in a horizontal plane to adjust the inclination of the tread structure.

Another objective of the present invention is to provide a treadmill having a fold-up capability whereby the tread structure may be selectively locked in a substantially upright storage configuration.

These and other objectives and advantages are obtained by the improved folding exercise treadmill with front inclination of the present invention, the general nature of which may be stated as including a support structure adapted to be disposed against a floor, at least a first pivot hub mounted on the support structure, an inclination mechanism including a lift assembly and an adjustment drive, the lift assembly being pivotally mounted on the at least first pivot hub, the adjustment drive being operationally mounted on the lift assembly, a tread structure having a front and a rear, a pivot member disposed on the tread structure, the pivot member being pivotally mounted on the lift assembly, the at least first pivot hub being disposed toward the rear of the tread structure from the pivot member, the tread structure being selectively moveable between an exercise configuration and a storage configuration, and the inclination mechanism selectively adjusting the vertical position of the front of the tread structure with respect to the floor to vary the inclination of the tread structure with respect to the floor when the tread structure is in the exercise configuration.

BRIEF DESCRIPTION OF THE DRAWINGS

The preferred embodiments of the invention, illustrative of the best modes in which Applicant has contemplated applying the principles of invention, are set forth in the following description and are shown in the drawings and are particularly and distinctly pointed out and set forth in the appended Claims.

Similar numerals refer to similar parts throughout the specification.

DESCRIPTION OF THE PREFERRED EMBODIMENTS

Figure 1:
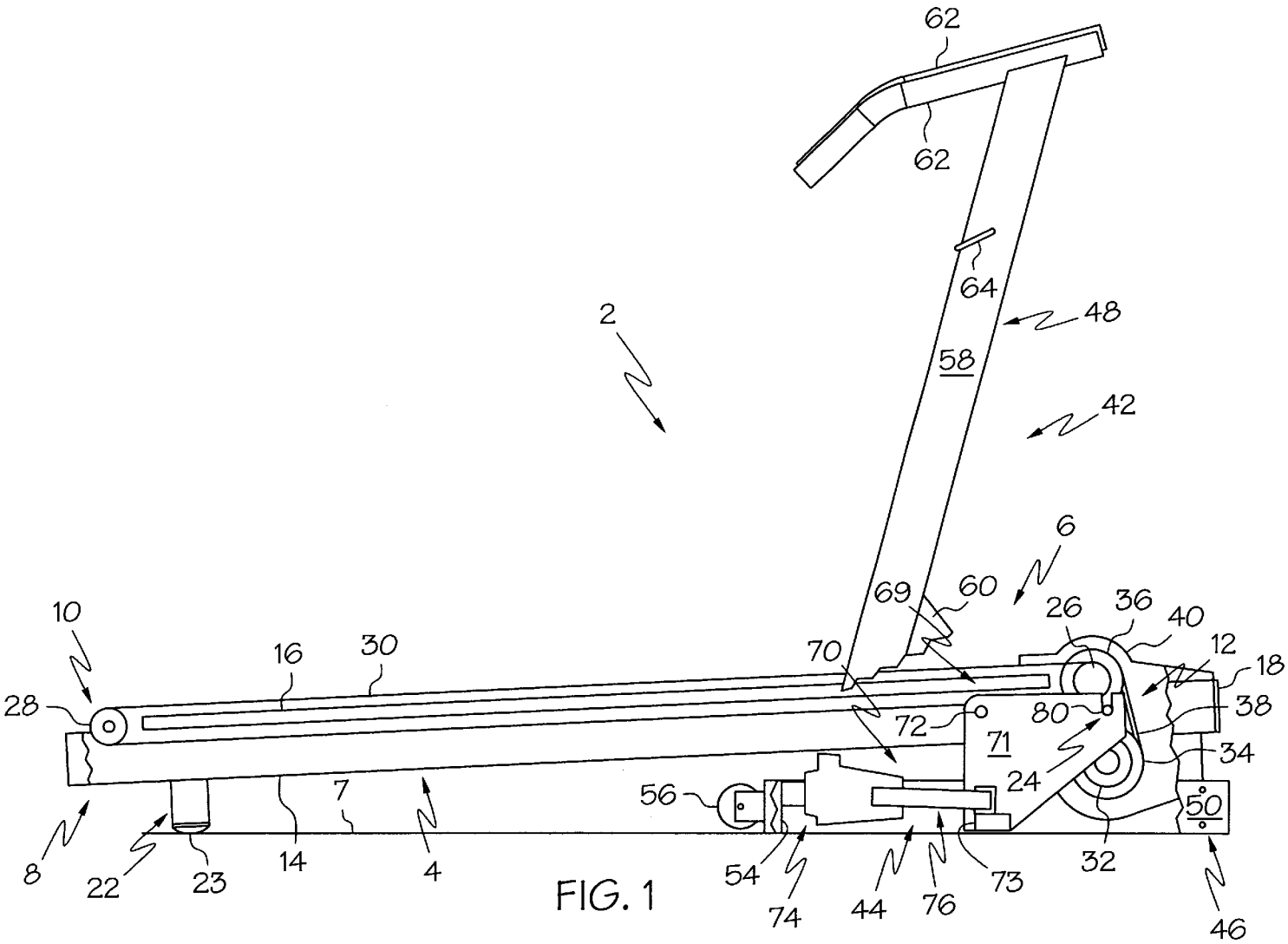
FIG. 1 is a side elevational view, partially cut away, of a first embodiment of the treadmill of the present invention in an exercise configuration.

The treadmill of the present invention is indicated generally at the numeral 2 in FIGS. 1–4. Treadmill 2 includes a tread structure 4 that is mounted on a support structure 6. Treadmill 2 rests against a substantally horizontal floor surface 7 and provides physical exercise to a user. In accordance with the objectives of the present invention, and as will be set forth more fully below, treadmill 2 possesses a fold-up capability whereby tread structure 4 may be selectively moved between an exercise configuration (FIG. 1) in which treadmill 2 is available for use by a user and a storage configuration (FIG. 2 ) that reduces the floor space occupied by treadmill 2 when not in use. Further in accordance with the objectives of the present invention, and as set forth more fully below, the inclination of tread structure 4 with respect to floor 7 is selectively variable to simulate walking, jogging, or running up a hill or incline.

Tread structure 4 includes a substantially rectangular tread frame 8 upon which are mounted a conveyor assembly 10 and a drive assembly 12. Tread frame 8 includes a pair of elongated parallel and spaced apart side rails 14, a substantially planar support plate 16 extending between and attached to side rails 14, and a front plate 18 and a rear plate 20 that are parallel and spaced apart and extend between the adjacent and spaced apart ends of side rails 14. Front plate 18 is disposed at the front of tread structure 4, and rear plate 20 is disposed at the rear of tread structure 4. Each side rail 14 includes a foot 22 depending downwardly therefrom, with each foot 22 being formed with a curved face 23 that rests against floor 7 when tread structure 4 is in the exercise configuration. Side rails 14, front plate 18, and rear plate 20 together provide a rigid, substantially rectangular frame upon which conveyor assembly 10 is mounted, as will be set forth more fully below.

Tread frame 8 additionally includes a pivot member 24 that pivotally connects tread structure 2 with support structure 4. In the first embodiment, pivot member 24 is a pair of coaxial and substantially cylindrical pins, each pin being disposed on the outer surface of one of side rails 14 and extending outwardly therefrom in a direction away from support plate 16. As is best shown in FIG. 1, pivot member 24 is disposed near front plate 18, but is spaced slightly therefrom in the direction of rear plate 20. It is understood, however, that pivot member 24 may be of numerous configurations other than that presented herein without departing from the spirit of the present invention. As will be set forth more fully below, tread structure 4 pivots about pivot member 24 both when the inclination of tread structure is being adjusted as well as when treadmill 2 is being converted from the exercise configuration to the storage configuration.

Conveyor assembly 10 of tread structure 4 includes a drive roller 26, an idler roller 28, and an endless conveyor belt 30. Drive roller 26 extends between side rails 14 and is rotatably attached thereto with known structures such as bearings, bushings, and the like. Drive roller 26 is disposed near front plate 18 and is oriented substantially parallel therewith. Idler roller 28 extends between side rails 14 and is rotatably attached thereto with known structures such as bearings, bushings, and the like. Idler roller 28 is disposed near rear plate 20 and is oriented parallel with and spaced from drive roller 26.

Conveyor belt 30 is an endless conveyor belt of the type known and understood in the relevant art and may be rubberized and/or include strengthening carcasses depending upon the needs of the particular application. Conveyor belt 30 operationally extends about drive roller 26 and idler roller 28 such that rotational movement of drive roller 26 causes translational movement of conveyor belt 30 and consequential rotational movement of idler roller 28 in conjunction therewith. As is understood in the relevant art, conveyor belt 30 is mounted on drive roller 26 and idler roller 28 such that at least a nominal level of tension exists in conveyor belt 30. It is thus preferred that conveyor assembly 10 additionally includes an adjustment mechanism that selectively adjusts the residual tension in conveyor belt 30 by adjusting the position of drive roller 26 and/or idler roller 28 or performs some other adjustment function to adjust the tension in conveyor belt 30 in a manner appropriate with the use of treadmill 2. It is understood, however, that such an adjustment mechanism does not affect the concept of the present invention.

As is best shown in FIG. 1, support plate 16 extends substantially between drive roller 26 and idler roller 28 and is slightly spaced from each. As will be set forth more fully below, conveyor belt 30 slides along the upper surface of support plate 16 as a user walks or runs upon the uppermost surface of conveyor belt 30. Support plate 16 thus provides support for conveyor belt 30 in the vertical direction between drive roller 26 and idler roller 28.

Drive assembly 12 of tread structure 4 includes a drive motor 32 mounted on the underside of tread frame 8, a drive pulley 34 operatively mounted on drive motor 32, a reaction pulley 36 axially mounted on drive roller 26, and a belt 38 operatively extending between drive pulley 34 and reaction pulley 36. Drive motor 32 is any of a wide variety of electric drive motors of the type known and understood in the relevant art that are capable of selective operation at a variety of rotational speeds. Drive motor 32 drives drive pulley 34 which, in turn, operates belt 38 which turns reaction pulley 36. The rotation of reaction pulley 36 drives drive roller 26, thus causing conveyor belt 30 to turn about drive roller 26 and idler roller 28. Drive motor 32 thus causes the operative rotation of conveyor belt 30 on tread structure 4.

A housing 40 is preferably provided to cover drive assembly 12, thus preventing foreign objects from being caught in drive motor 32 or between belt 38 and drive pulley 34 or reaction pulley 36. It is understood that housing 40 may take on many configurations without affecting the concept of the present invention.

Support structure 6 includes a support frame 42 and an inclination mechanism 44. Inclination mechanism 44 is operatively mounted on support frame 42 and adjusts the inclination of tread structure 4 with respect to floor 7. Support frame 42 includes a frame base 46 and a pair of uprights 48 extending upwardly therefrom. Frame base 46 is configured to rest securely against floor 7 and to support uprights 48 in the vertical direction.

Frame base 46 includes a pair of parallel and spaced apart side legs 50 and a front cross member 52 and a rear cross member 54 that are parallel and spaced apart and extend between adjacent and spaced apart ends of side legs 50 to form a substantially rectangular structure. A pair of casters 56 are preferably mounted on rear cross member 54 to facilitate moving treadmill 2 when treadmill 2 is in the storage configuration. While side legs 50 and front and rear cross members 52 and 54 are depicted as all being disposed against floor 7, it is understood that other configurations are possible in which, for instance, front and rear cross members 52 and 54 are spaced from floor 7 without affecting the concept of the present invention.

Uprights 48 are each attached to one of side legs 50 and each include a post 58 extending upwardly from side leg 50, a cross bar 60 extending between the midsection of the post 58 and the side leg 50, and a handle 62 disposed at the top of the post 58. Cross bar 60 provides a triangulated support that rigidly secures post 58 to side leg 50.

Uprights 48 are thus disposed at alternate sides of tread structure 4 and provide support to a user to prevent the user from inadvertently falling from treadmill 2 when in use. Handles 62 provide additional structures onto which the user can grasp for stability while using treadmill 2 and to prevent falling therefrom.

Figure 3:
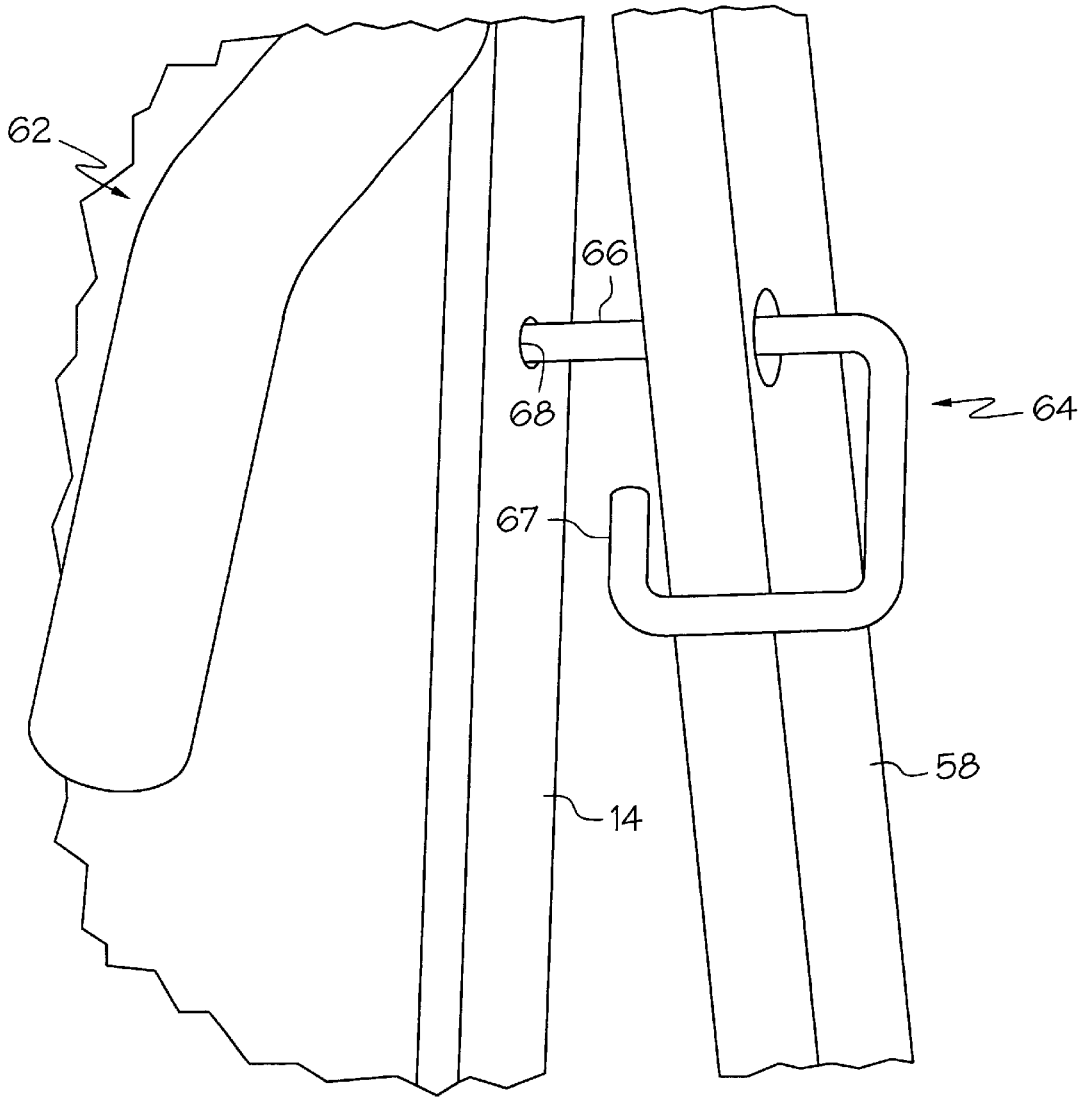
FIG. 3 is an enlarged view of the latch pin holding the tread structure in the storage configuration.
Figure 4:
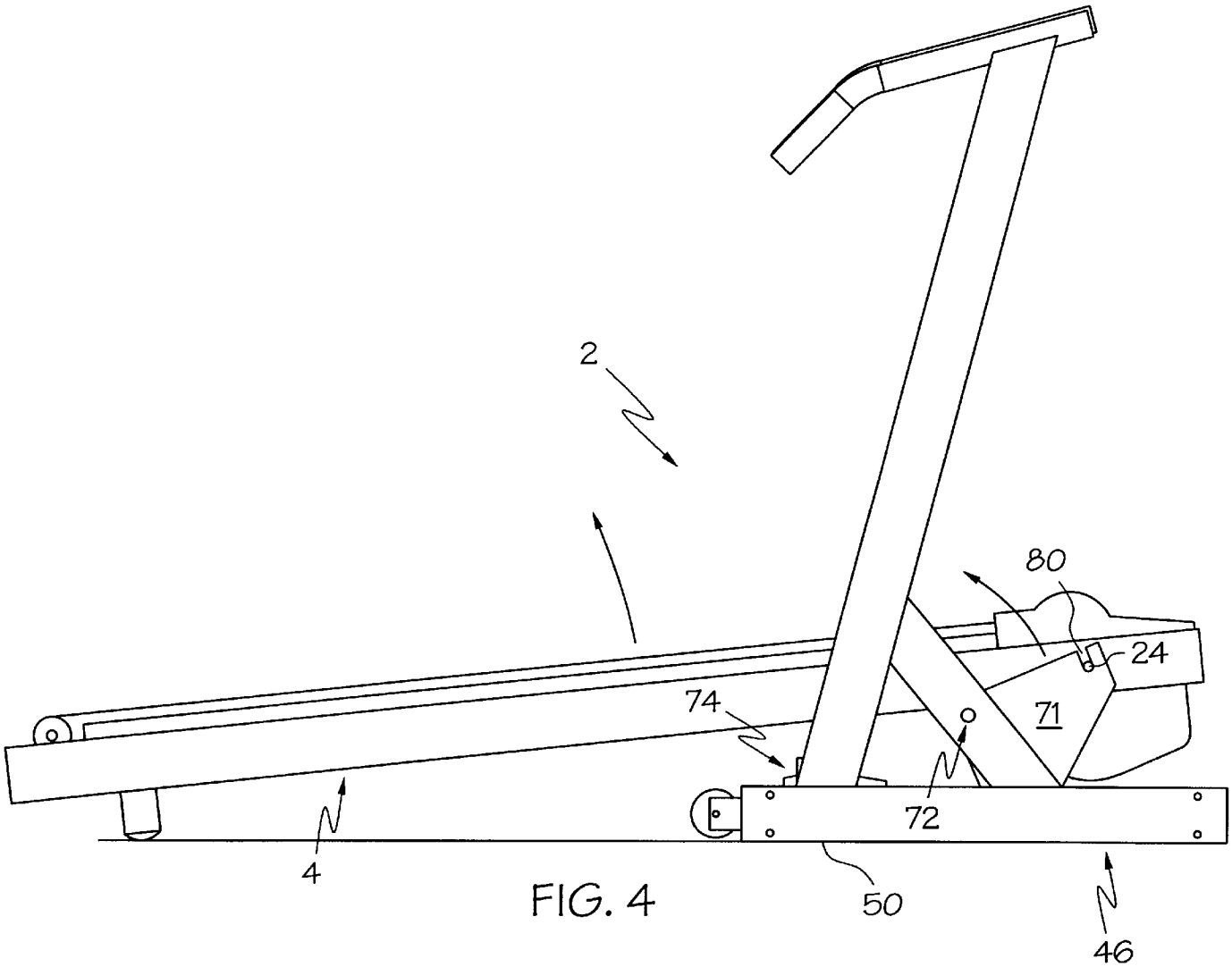
FIG. 4 is a view similar to FIG. 1 except showing the tread structure at a steeper inclination with respect to the floor.

As is best shown in FIG. 3, at least one of uprights 48 is formed with a hole that slidingly receives a latch pin 64 therein. Latch pin 64 includes an elongated, substantially cylindrical locking shank 66 and a retention leg 67. Retention leg 67 extends along an imaginary first axis that preferably is perpendicular with a second imaginary axis extending through locking shank 66. As is best shown in FIG. 3, tread structure 4 is formed with a hole 68 that is selectively alignable with locking shank 66 when tread structure 4 is in the storage configuration. When such alignment is achieved, latch pin 64 is slid through the hole formed in upright 48 until locking shank 66 is slidingly received in hole 68, with latch pin 64 then being rotated about the second imaginary axis until retention leg 67 is disposed adjacent the inner surface of upright 48. In such position, latch pin 64 is retained in hole 68 inasmuch as retention leg 67 blocks latch pin 64 from being pulled outwardly therefrom.

While treadmill 2 is depicted as including one latch pin 64, it is understood that both uprights 48 may include a latch pin 64, with corresponding holes 68 being formed in tread structure 4, without departing from the spirit of the present invention. Moreover, in additional embodiments, latch pin 64 may additionally include a spring that biases latch pin 64 away from tread structure 4 to a retracted state. To operate latch pin 64, the user pushes latch pin 64 through the hole in upright 48 until locking shank 66 is slidingly received in hole 68. The user then rotates latch pin 64 so that retention leg 67 wraps around upright 48 thus preventing the spring from biasing latch pin 64 to the retracted state out of engagement with tread structure 4. It is likewise understood that latch pin 64 may take on other shapes and configurations without departing from the spirit of the present invention.

Inclination mechanism 44 of support structure 6 includes a lift assembly 69 pivotally mounted on support frame 42 at a first pivot and an adjustment drive 70 that operatively extends between support frame 42 and lift assembly 69. Tread structure 4 is pivotally mounted at its front at a second pivot to lift assembly 69, and adjustment drive 70 selectively pivots lift assembly 69 with respect to support frame 42, thus selectively moving the front of tread structure 4 in the vertical direction and thus selectively adjusting the angle of tread structure 4 with respect to floor 7.

Figure 2:
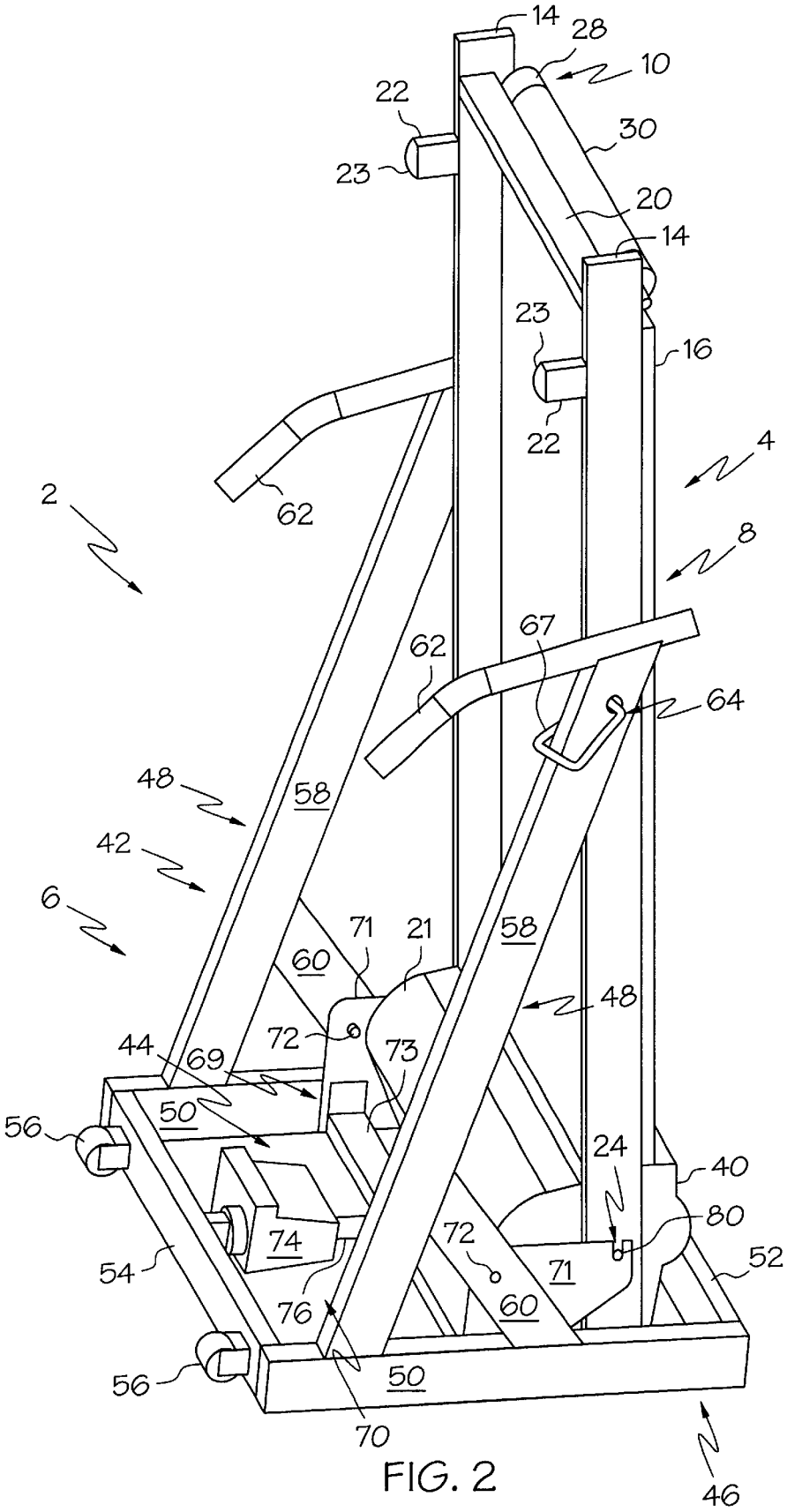
FIG. 2 is a perspective view of the first embodiment in a storage configuration.

Lift assembly 69 includes a pair of roughly triangular pivot plates 71, a pair of substantially cylindrical pivot hubs 72 coaxially mounted on cross bars 60 and extending toward one another, and a reaction bar 73 extending between pivot plates 71. As is best shown in FIG. 2, pivot plates 71 are each formed with a substantially circular hole disposed near one of the corners thereof that receives one of pivot hubs 72 such that pivot plates 71 are pivotally mounted on pivot hubs 72. Reaction bar 73 is fixedly attached to and extends between the lower corners of pivot plates 71. Inasmuch as reaction bar 73 is spaced from pivot hubs 72, movement of reaction bar 73 causes pivot plates 71 to pivot about pivot hubs 72, with reaction bar 73 thus constituting a third pivot.

Pivot plates 71 are each formed with a groove 80 on the upper surface thereof adjacent the corner opposite the attachment with pivot hub 72 and opposite the attachment to reaction bar 73. Grooves 80 are generally U-shaped and are sized to pivotally retain pivot member 24 therein. Inasmuch as grooves 80 are each disposed at the opposite end of pivot plates 71 from pivot hubs 72, the selective pivoting of pivot plates 71 about pivot hubs 72 causes grooves 80 to selectively move a corresponding distance in the vertical direction, either up or down depending on the direction in which pivot plates 71 pivot.

Adjustment drive 70 of inclination mechanism 44 includes an adjustment motor 74 mounted to rear cross member 54 and an extension rod 76 extending from adjustment motor 74 and mounted on reaction bar 73. Adjustment motor 74 selectively extends and retracts extension rod 76, thus selectively varying the distance between reaction bar 73 and rear cross member 54. Inasmuch as rear cross member 54 is fixed in relation to uprights 48 and thus pivot hubs 72, the selective movement of reaction bar 73 by adjustment drive 70 results in reaction bar 73 and pivot plates 71 being selectively rotated about pivot hubs 72.

Inasmuch as reaction bar 73 pivots about pivot hubs 72 in conjunction with pivot plates 71, adjustment motor 74 and extension rod 76 are pivotally mounted to rear cross member 54 and reaction bar 73, respectively. Inasmuch as adjustment motor 74 selectively advances and retracts extension rod 76, adjustment motor 74 and extension rod 76 may be any of a variety of cooperative devices such as a motorized gear box and a threaded rod, a gas-pressurized spring having a selectively extensible piston rod, a motorized rack and pinion assembly, a chain and a pair of sprockets, as well as other structures of the type known and understood in the relevant art. It is understood, therefore, that adjustment motor 74 and extension rod 76 may be any of a variety of cooperative structures that selectively cause the rotation of pivot plates 71 about pivot hubs 72.

In operation, drive motor 32 drives conveyor belt 30 about drive roller 26 and idler roller 28 as a user walks or runs on the uppermost surface of conveyor belt 30. The weight of the user imparts a downward force onto conveyor belt 30 with conveyor belt 30 thus being compressed against the upper surface of support plate 16. Inasmuch as conveyor belt 30 is translated by drive motor 32 when in use, conveyor belt 30 slips along the upper surface of support plate 16. In this regard, it is understood that support plate 16 may include a friction abatement system such as a plurality rollers or a low friction coating to alleviate the friction caused by the translation or conveyor belt 30 thereon. Such a friction abatement system does not, however, affect the concept of the present invention.

The user selects an appropriate rotational speed of drive motor 32 that corresponds with an appropriate translation speed for conveyor belt 30 on tread structure 4. In this regard, the user may vary the speed of conveyor belt 30 to provide a workout that is selectively more or less vigorous.

In accordance with the objectives of the present invention, the user also may selectively vary the inclination of tread structure 4 with respect to floor 7 to simulate walking, jogging, or running up a hill or incline. Inasmuch as pivot member 24 is pivotally disposed in grooves 80 formed in pivot plates 71, the pivotal movement of pivot plates 71 about pivot hubs 72 by adjustment drive 70 selectively raises and lowers pivot member 24. When treadmill 2 is in the exercise configuration, the rear of tread structure 4 rests against floor 7 on feet 22. The selective raising and lowering of the front of tread structure 4 due to the rotation of pivot plates 71 about pivot hubs 72 causes tread structure to pivot about faces 23 of feet 22, thus selectively adjusting the angle of tread structure 4 with respect to floor 7. Inasmuch as grooves 80 selectively pivot about an arc having a radius that is less than the radius of the arc through which pivot member 24 travels with respect to feet 22, it is understood that in varying the inclination of tread structure 4 with respect to floor 7 faces 23 of feet 22 may at least nominally scrub a short distance along floor 7 during such adjustment.

In accordance with the features of the present invention, by positioning pivot plates 71 such that pivot hubs 72 are disposed in the direction toward rear plate 20 with respect to pivot member 24, the quantity of treadmill apparatus disposed in front of front plate 18 is minimized. Treadmill 2 may thus be positioned with front plate 18 and front cross member 52 closely adjacent a vertical wall without the need for treadmill 2 to be spaced from the vertical wall to provide space for large lifting structures to be disposed therebetween.

Further in accordance with the objectives of the present invention, by adjusting the vertical position of the front of tread structure 4 while retaining the rear of tread structure 4 against floor 7 on feet 22 when treadmill 2 is in the exercise configuration, all of the adjustment structures are disposed in or adjacent support frame 42. Additionally, as is understood in the relevant art, users of treadmill 2 typically walk or run at or near the rear of tread structure 4, with repetitious shock loading occurring to the rearmost structures during the use of treadmill 2. The placement of inclination mechanism 44 at the front of tread structure 4 thus reduces the exposure of inclination mechanism 44 to the repeated shock loading that occurs during the use of treadmill 2 while instead subjecting feet 22 to the aforementioned shock loading. By minimizing the shock loading on inclination mechanism 44, inclination mechanism 44 is thus less subject to wear and breakage resulting therefrom.

By orienting adjustment drive 70 in a substantially horizontal orientation is to operate pivot plates 71, the rotation of adjustment motor 74 about rear cross member 54 is minimized. Additionally, by positioning adjustment drive 70 in a substantially horizontal orientation, treadmill 2 obviates the need for adjustment drive 70 to be in a compact configuration to permit adjustment drive 70 be disposed vertically between the underside of tread structure 4 and floor 7, thus limiting the cost of treadmill 2.

When treadmill 2 is in the exercise configuration, faces 23 of feet 22 are disposed against floor 7. In converting treadmill 2 into the storage configuration, the user lifts the rear of tread structure 4 in the upward direction, thus causing tread structure 4 to pivot about pivot member 24 until tread structure 4 is in a substantially upright orientation and hole 68 formed in tread structure 4 is aligned with locking shank 66 of latch pin 64. In accordance with the objectives of the present invention, therefore, when treadmill 2 is in the storage configuration, the floor space occupied by treadmill 2 is limited essentially to that occupied by frame base 46.

Once treadmill 2 is in the storage configuration, treadmill 2 may be repositioned by rolling it along floor 7 on casters 56. More specifically, inasmuch as tread structure 4 is securely retained in relation to support structure 6 by latch pin 64, treadmill 2 may be tilted rearward onto casters 56, with casters 56 thus facilitating the rolling repositioning of treadmill 2 on floor 7.

Treadmill 2 is thus configured to substantially minimize the space it occupies when not in use. Inasmuch as the specific configuration of inclination mechanism 44 obviates the need for significant lifting structures to be disposed in front of front plate 18, which in turn obviates the need for front plate 18 to be substantially spaced from a vertical wall, the configuration of inclination mechanism 44 further reduces the amount of floor space that is occupied or otherwise rendered unavailable when treadmill 2 is in the storage configuration. Treadmill 2 thus provides significant advantages and benefits beyond other treadmills known and understood in the relevant art.

Figure 5:
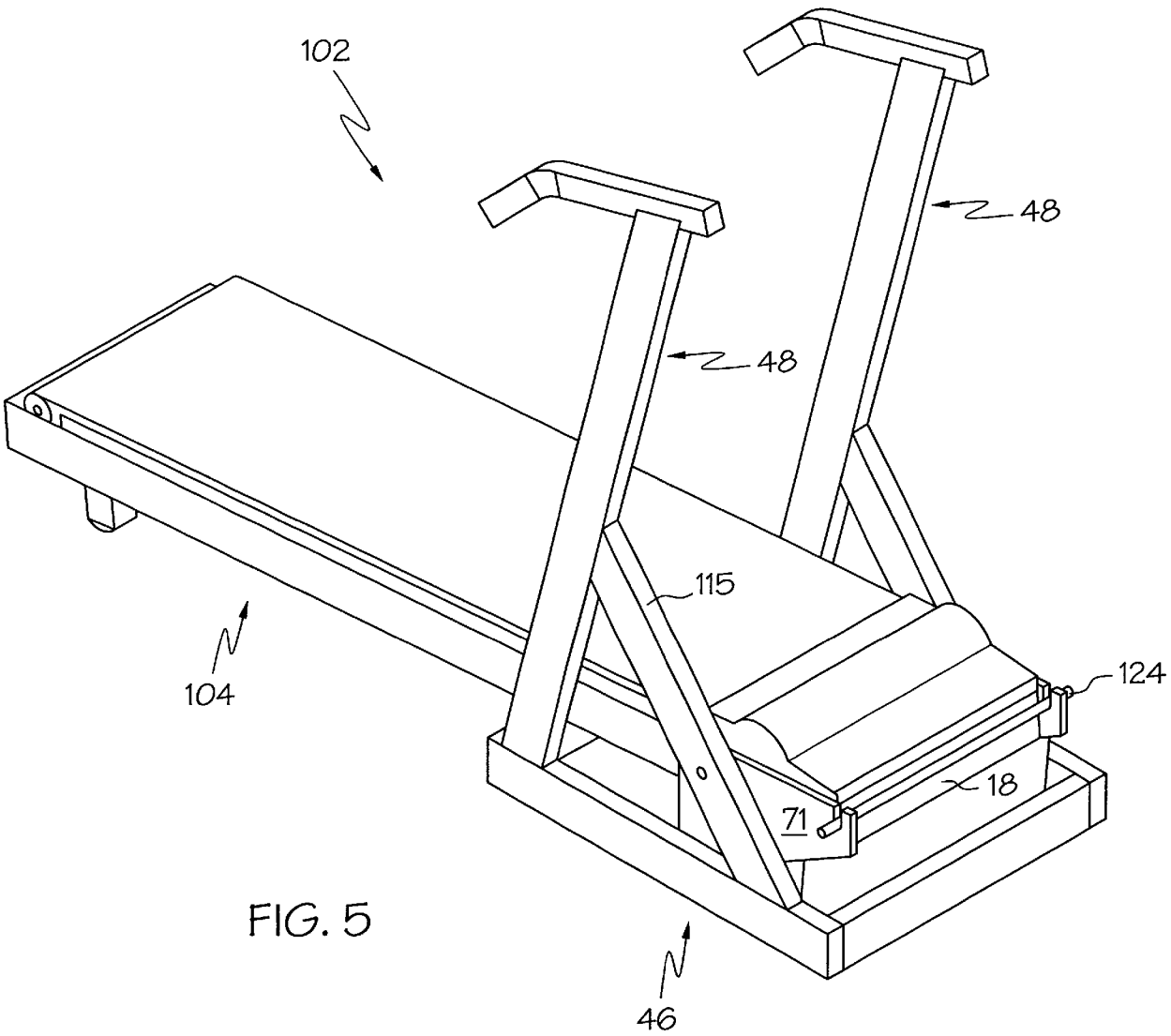
FIG. 5 is a perspective view of a second embodiment of the treadmill of the present invention in an exercise configuration.

A second embodiment of the treadmill of the present invention is indicated generally at the numeral 102 in FIG. 5. Treadmill 102 is similar to treadmill 2, except that pivot member 124 is a rod that is disposed at the front surface of front plate 18 and extends outwardly from alternate sides of tread frame 8. When treadmill 102 is converted from the exercise configuration to the storage configuration, tread structure 104 thus pivots upwardly about pivot member 124, which is disposed at the frontmost portion of tread structure 104.

Moreover, when the inclination of tread structure 104 is adjusted with respect to floor 7, a lesser amount of adjustment force is required inasmuch as the lever arm between pivot member 124 and feet 22 is greater than that of treadmill 2.

Figure 6:
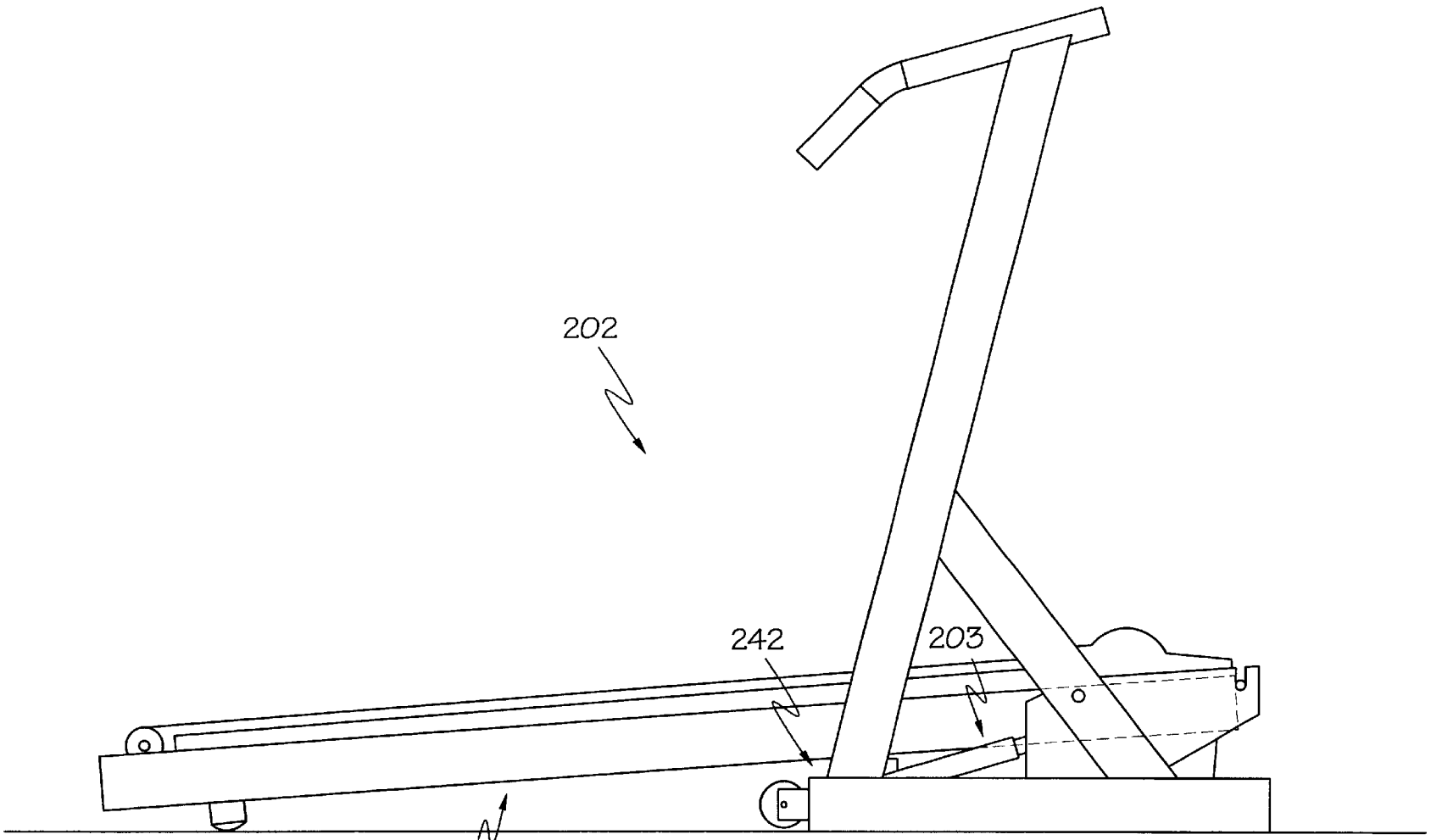
FIG. 6 is a side elevational view of a third embodiment of the treadmill of the present invention in an exercise configuration.
Figure 7:
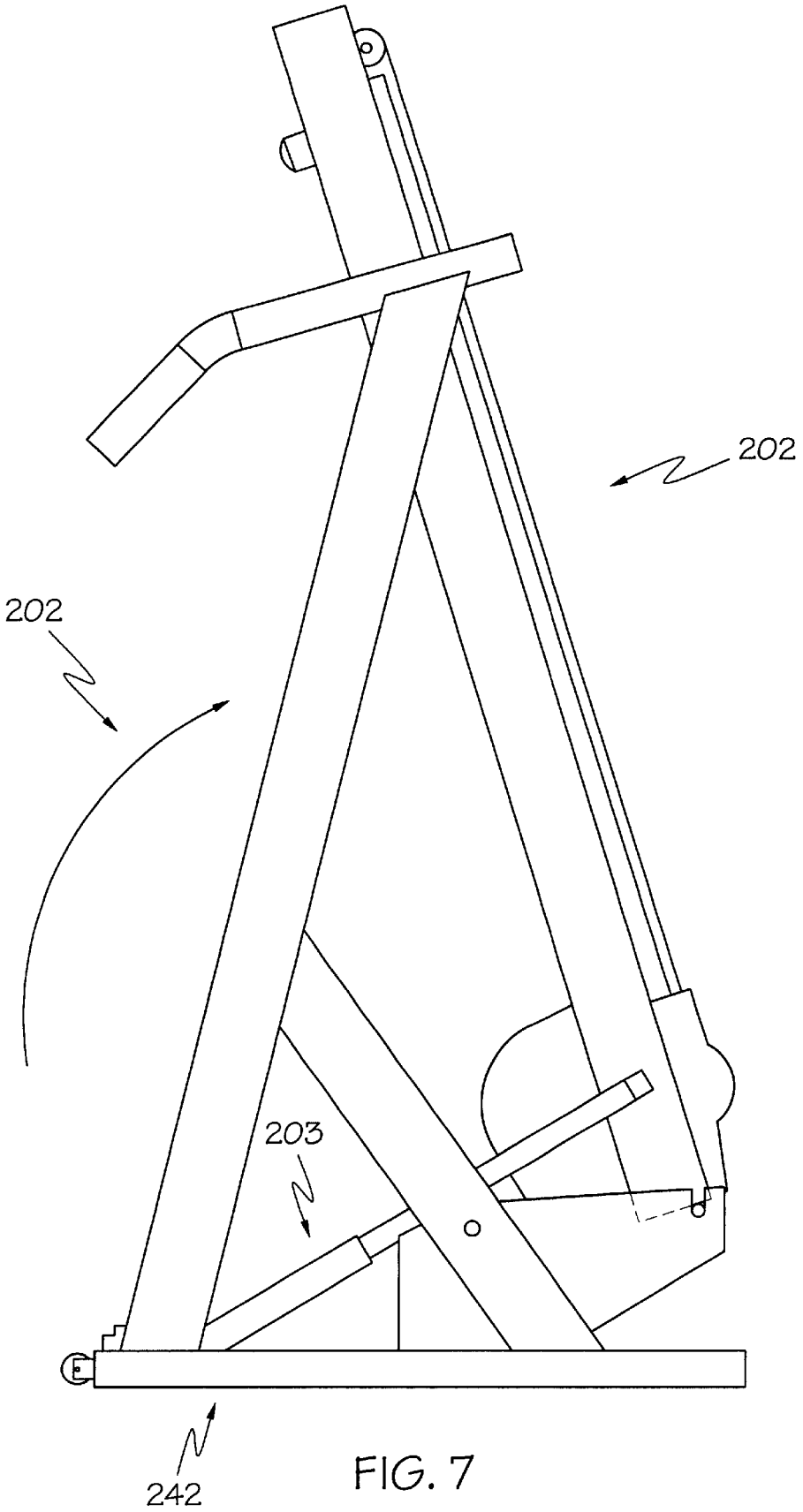
FIG. 7 is a side elevational view of the third embodiment in a storage configuration.

A third embodiment of the treadmill of the present invention is indicated generally at the numeral 202 in FIGS. 6 and 7. Treadmill 202 is similar to treadmill 102, except that treadmill 202 additionally includes a pair of pressurized gas cylinders 203 that are operationally interposed between support frame 242 and tread structure 204. Gas cylinders 203 operate as lifting drivers inasmuch as they provide an upward expansive force on tread structure 204, thus reducing the upward force required in lifting tread structure 204 to convert exercise device 202 from the exercise configuration to the storage configuration.

Accordingly, the improved folding exercise treadmill with front inclination apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terns have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the folding exercise treadmill with front inclination is constructed and used, the characteristics of the construction, and the advantageous new and useful results obtained; the new and useful structures, devices, elements, arrangements, parts, and combinations are set forth in the appended Claims.

I claim:

1. An exercise treadmill adapted to be disposed on a substantially horizontal floor, the treadmill comprising:

a support structure adapted to be disposed against the floor;

a lift assembly being pivotally mounted on the support structure at a first pivot;

a conveyor assembly having a front and a rear, the conveyor assembly being pivotally mounted on the lift assembly at a second pivot;

an extendable and retractable adjustment mechanism mounted on the support structure at a third pivot;

the at least first pivot being intermediate the second pivot and the rear of the conveyor assembly; and the first, second and third pivots being oriented such that the movement of the second pivot is generally perpendicular to the movement of the third pivot point.

2. The treadmill as set forth in claim 1, further comprising an adjustment drive disposed intermediate the support structure and the lift assembly.

3. The treadmill as set forth in claim 2, wherein the adjustment drive is oriented substantially horizontally.

4. The treadmill as set forth in claim 1, further comprising a tread frame and a drive motor, the conveyor assembly and the drive motor being mounted on the tread frame.

5. The treadmill as set forth in claim 1, further comprising a latch pin, the latch pin selectively retaining the conveyor assembly in the storage configuration.

6. The treadmill as set forth in claim 5, wherein the latch pin selectively holds the conveyor assembly in fixed relation with the support structure.

7. The treadmill as set forth in claim 6, wherein the latch pin includes a locking shank and a retention leg.

8. The treadmill as set forth in claim 7, wherein the locking shank is perpendicular to the retention leg.

9. The treadmill as set forth in claim 1, further comprising a pivot member operationally disposed at the second pivot, the pivot member being closer to the front of the conveyor assembly than the rear of the conveyor assembly.

10. The treadmill as set forth in claim 9, further comprising a tread frame, the conveyor assembly being mounted on the tread frame, the pivot member being spaced from the front of the tread frame.

11. The treadmill as set forth in claim 10, wherein the pivot member is disposed at the front of the tread frame.

12. The treadmill as set forth in claim 1, further comprising a tread frame and at least a first lifting driver, the conveyor assembly mounted on the tread frame, the at least first lifting driver being operatively mounted on the tread frame.

13. The treadmill as set forth in claim 12, wherein the at least first lifting driver is a gas cylinder.

14. The treadmill as set forth in claim 12, wherein the at least first lifting driver extends between the tread frame and the support structure.

15. The treadmill as set forth in claim 1, wherein the lift assembly includes a pair of substantially parallel and planar pivot plates and a reaction bar extending between the pivot plates.

16. The treadmill as set forth in claim 15, further comprising an adjustment drive intermediate the support structure and the reaction bar.

17. The treadmill as set forth in claim 15, wherein the pivot plates are each formed with a generally U-shaped groove, the pivot member being pivotally seated in the grooves.

18. The treadmill as set forth in claim 1, further comprising an adjustment drive, wherein the support structure includes a frame base and pair of uprights, the frame base including a pair of side rails, a front cross member, and a rear cross member, the side rails and the front and rear cross members connected to one another in a generally rectangular configuration, the side rails and the front and rear cross members all being adapted to be disposed against the floor, the distance between the front cross member and the front of the conveyor assembly being less than the distance between the rear cross member and the front of the conveyor assembly, the adjustment drive extending between the rear cross member and the lift assembly.

19. The treadmill as set forth in claim 18, further comprising a pair of casters disposed on the rear cross member.

20. The treadmill as set forth in claim 1, wherein the conveyor assembly is selectively moveable between an exercise configuration and a storage configuration.

21. The treadmill as set forth in claim 1, further comprising an adjustment drive and means for converting substantially horizontal extension of the adjustment drive into substantially vertical movement of the second pivot.

22. The treadmill as set forth in claim 1, wherein the lift assembly selectively adjusts the vertical position of the front of the conveyor assembly to vary the inclination of the conveyor assembly with respect to the floor when the conveyor assembly is in the exercise configuration.

23. An exercise treadmill adapted to be disposed on a substantially horizontal floor, the treadmill comprising:

a support structure adapted to be disposed against the floor;

a pair of pivot hubs mounted on the support structure;

an inclination mechanism including a lift assembly and an adjustment drive;

the lift assembly including a pair of substantially parallel and spaced apart pivot plates and a reaction bar extending between the pivot plates;

the pivot plates being pivotally mounted on the pivot hubs;

the pivot plates each being formed with a generally U-shaped groove, the grooves being spaced from the pivot hubs;

the adjustment drive being operationally mounted between the support assembly and the reaction bar;

a tread frame pivotally mounted on the pivot plates, the tread frame having a front and a rear;

a conveyor assembly mounted on the tread frame;

a pivot member disposed on the tread frame, the pivot member being pivotally mounted in the grooves;

the pivot hubs being disposed toward the rear of the tread frame from the pivot member;

the conveyor assembly being selectively moveable between an exercise configuration and a storage configuration;

a latch pin disposed on the support structure, the latch pin selectively retaining the conveyor assembly in the storage configuration; and the inclination mechanism selectively adjusting the vertical position of the front of the conveyor assembly when the conveyor assembly is in the exercise configuration to vary the inclination of the conveyor assembly with respect to the floor.

24. An exercise treadmill comprising:

a frame;

a pivot plate pivotally mounted on the frame at a first pivot;

a conveyor assembly having a front and a rear, the front being pivotally mounted on the pivot plate at a second pivot;

an extendable and retractable adjustment mechanism mounted to the pivot plate at a third pivot; and the first, second, and third pivots being oriented such that the direction of the movement of the second pivot is substantially perpendicular to the movement of the third pivot point.

* * * * *